US011535964B2

(12) United States Patent
Kashima

(10) Patent No.: US 11,535,964 B2
(45) Date of Patent: Dec. 27, 2022

(54) WEFT KNIT FABRIC

(71) Applicant: Asahi Kasei Kabushiki Kaisha, Tokyo (JP)

(72) Inventor: Norito Kashima, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/423,998

(22) PCT Filed: Jan. 30, 2020

(86) PCT No.: PCT/JP2020/003544
§ 371 (c)(1),
(2) Date: Jul. 19, 2021

(87) PCT Pub. No.: WO2020/158898
PCT Pub. Date: Aug. 6, 2020

(65) Prior Publication Data

US 2022/0081810 A1 Mar. 17, 2022

(30) Foreign Application Priority Data

Feb. 1, 2019 (JP) ..... JP2019-017027

(51) Int. Cl.
*D04B 1/18* (2006.01)

(52) U.S. Cl.
CPC ..... *D04B 1/18* (2013.01)

(58) Field of Classification Search
CPC ... D04B 1/18; D04B 1/16; D04B 1/22; D04B 7/16; D04B 7/18; D04B 9/42; D04B 9/08
See application file for complete search history.

(56) References Cited

U.S. PATENT DOCUMENTS 2,067,739 A * 1/1937 Tanski ..... D04B 15/80 66/196
5,651,847 A * 7/1997 Loeffler ..... D04B 1/16 66/196

(Continued)

FOREIGN PATENT DOCUMENTS

JP S57-039986 U 3/1982
JP S63-167183 U 10/1988

(Continued)

OTHER PUBLICATIONS

Supplementary European Search Report issued in corresponding European Patent Application No. 20749599.5 dated Feb. 18, 2022.

(Continued)

*Primary Examiner* — Danny Worrell
(74) *Attorney, Agent, or Firm* — Morgan, Lewis & Bockius LLP

(57) ABSTRACT

Provided is a weft knit fabric with excellent raw edge properties and flexural softness. This weft knit fabric, which contains non-elastic yarns and elastic yarns and has a front surface and a back surface, is characterized in that: the elastic yarns connect the front surface with the back surface; the front surface and the back surface have portions wherein the non-elastic yarns and the elastic yarns form needle loops together; and the ratio of the number of sinker loops formed by the non-elastic yarns and the elastic yarns together with respect to the total number of sinker loops of the non-elastic yarns on the front surface and the back surface is not more than 50%.

10 Claims, 15 Drawing Sheets

Solid line (white) = needle loop
Dotted line (white) = sinker loop

(56) References Cited

U.S. PATENT DOCUMENTS

| | | | | |
|---|---|---|---|---|
| 5,687,587 | A * | 11/1997 | Michel | D04B 1/18 66/196 |
| 6,779,369 | B2 * | 8/2004 | Shepherd | D04B 1/126 66/196 |
| 7,849,715 | B2 * | 12/2010 | Starbuck | A41C 5/00 66/196 |
| 7,867,056 | B2 * | 1/2011 | Scheininger | D04B 1/246 450/74 |
| 7,867,057 | B2 * | 1/2011 | Scheininger | D04B 1/246 450/74 |
| 7,937,973 | B2 * | 5/2011 | Sorensen | A61F 13/04 66/196 |
| 9,551,095 | B2 * | 1/2017 | Lee | D04B 15/367 |
| 9,725,835 | B2 * | 8/2017 | Vaglio Tessitore | D04B 1/16 |
| 10,145,042 | B2 * | 12/2018 | Diaz | A41C 3/0057 |
| 10,455,885 | B2 * | 10/2019 | Tamm | A43B 5/02 |
| 2002/0111100 | A1 | 8/2002 | Sheu | |
| 2004/0099016 | A1 | 5/2004 | Shepherd | |
| 2004/0168479 | A1 * | 9/2004 | McMurray | D04B 1/16 66/202 |
| 2004/0237599 | A1 | 12/2004 | Kondou et al. | |
| 2008/0032580 | A1 | 2/2008 | Fukuoka et al. | |
| 2010/0170300 | A1 | 7/2010 | Yanagi et al. | |
| 2016/0138203 | A1 | 5/2016 | Akita | |

FOREIGN PATENT DOCUMENTS

| | | | |
|---|---|---|---|
| JP | H07-138850 | A | 5/1995 |
| JP | H07-207551 | A | 8/1995 |
| JP | 2004-052157 | A | 2/2004 |
| JP | 2005-113349 | A | 4/2005 |
| JP | 2005-350800 | A | 12/2005 |
| JP | 2007-177359 | A | 7/2007 |
| JP | 2014-201854 | A | 10/2014 |
| WO | 97/16587 | A1 | 5/1997 |
| WO | 03/038173 | A1 | 5/2003 |
| WO | 2015/005432 | A1 | 1/2015 |

OTHER PUBLICATIONS

International Search Report issued in corresponding International Patent Application No. PCT/JP2020/003544 dated Apr. 21, 2020.
International Preliminary Report on Patentability and Written Opinion issued in corresponding International Patent Application No. PCT/JP2020/003544 dated Aug. 12, 2021.

* cited by examiner

Solid line (white) = needle loop
Dotted line (white) = sinker loop

Solid line (white) = needle loop
Dotted line (white) = sinker loop

Solid line (white) = needle loop
Dotted line (white) = sinker loop

Solid line = Non-elastic yarn
Dotted line = Elastic yarn

Solid line = Non-elastic yarn
Dotted line = Elastic yarn

1

2

Solid line = Non-elastic yarn
Dotted line = Elastic yarn

1

2

3

4

Solid line = Non-elastic yarn
Dotted line = Elastic yarn

1

2

3

4

Solid line = Non-elastic yarn
Dotted line = Elastic yarn

Solid line = Non-elastic yarn
Dotted line = Elastic yarn

1

2

3

4

Solid line = Non-elastic yarn
Dotted line = Elastic yarn

1

2

Solid line = Non-elastic yarn
Dotted line = Elastic yarn

1

2

Solid line = Non-elastic yarn
Dotted line = Elastic yarn

Solid line = Non-elastic yarn
Dotted line = Elastic yarn

1

2

Solid line = Non-elastic yarn
Dotted line = Elastic yarn

Solid line = Non-elastic yarn
Dotted line = Elastic yarn

Solid line = Non-elastic yarn
Dotted line = Elastic yarn

Solid line = Non-elastic yarn
Dotted line = Elastic yarn

1

Solid line = Non-elastic yarn
Dotted line = Elastic yarn

1

2

Solid line = Non-elastic yarn
Dotted line = Elastic yarn

Solid line = Non-elastic yarn
Dotted line = Elastic yarn

WEFT KNIT FABRIC

FIELD

The present invention relates to a weft knit fabric.

BACKGROUND

Market demand continues to increase year-by-year for more comfortable clothing, with particular preference for underwear that has a satisfactory skin contact and a soft feel.

When conventional clothing is produced from a fabric, the cut sections of the fabric are sewn to help prevent fraying or curling of the threads at the cut sections, but this leads to problems of impaired outer appearance due to the effects of irregularities at the sewn sections, and also a less desirable wearable feel since the sewn sections are compressed by outer clothing. Clothing with good skin contact properties are marketed as "free-cut" clothing articles which lack sewing of the cut sections of their fabrics.

PTL 1, for example, discloses clothing produced using a knitted fabric that does not require sewing treatment at the cut sections. However, with knitted fabrics obtained by knitting heat-fused elastic yarn and non-elastic yarn by plating, followed by heat setting, the heat-fused elastic yarn and non-elastic yarn fuse over the entirety of the needle loop and sinker loop, and/or the apparent fiber size at the sinker loop is thickened, causing the knitted fabric to become difficult to bend and resulting in an undesirable feel. Moreover, since the knitted fabric is knitted by a single circular knitting machine, it is prone to curling.

PTL 2 discloses a double knitted fabric with a satisfactory free-cut property and satisfactory compressibility and compression recovery. However, the ground weave on the front and back has plating of non-elastic yarn and elastic yarn, and the heat-fused elastic yarn and non-elastic yarn fuse together throughout all of the needle loops and sinker loops, and/or the apparent fiber sizes at the sinker loops is thickened, causing the knitted fabric to become hard and resulting in an undesirable feel for underwear.

PTL 3 discloses a double knitted fabric with excellent elongatability and fray resistance. However, the ground weave on the front side and/or back side of the knitted fabric has plating of non-elastic yarn and elastic yarn, and the heat-bonded elastic yarn and non-elastic yarn fuse throughout all of the needle loops and sinker loops, and/or the apparent fiber sizes at the sinker loops are thickened, causing the knitted fabric to become hard and resulting in an undesirable feel for underwear.

CITATION LIST

Patent Literature

[PTL 1] Japanese Unexamined Patent Publication No. 2005-113349

[PTL 2] International Patent Publication No. 2003/038173

[PTL 3] Japanese Unexamined Patent Publication No. 2004-52157

SUMMARY

Technical Problem

In light of these circumstances, the problem to be solved by the invention is to provide a weft knit fabric having an excellent free-cut property and excellent bending softness.

Solution to Problem

As a result of diligent experimentation with the aim of solving this problem, the present inventors have found, unexpectedly, that the problem can be solved by the following construction, and the invention has been completed upon this finding.

Specifically, the present invention provides the following.

[1] A weft knit fabric comprising non-elastic yarn and elastic yarn and having a front side and a back side, wherein the elastic yarn connects the front side and back side, with the front side and the back side having sections that form needle loops by doubling of the non-elastic yarn and the elastic yarn, and the proportion of the number of sinker loops formed by doubling of the non-elastic yarn and elastic yarn is 50% or lower with respect to the total number of sinker loops of the non-elastic yarn on the front side and the back side.

[2] The weft knit fabric according to [1], which has no sections where the non-elastic yarn and elastic yarn form sinker loops by doubling.

[3] The weft knit fabric according to [1] or [2] above, wherein the proportion of the number of needle loops formed by doubling between the non-elastic yarn and the elastic yarn is 50% or greater with respect to the total number of needle loops of non-elastic yarn on the front side and the back side.

[4] The weft knit fabric according to any one of [1] to [3] above, wherein the non-elastic yarn composing either the front side or the back side does not connect with the other side.

[5] The weft knit fabric according to any one of [1] to [4] above, wherein when the weft knit fabric is elongated with a load of 9.8 N from both the warp and weft, the ratio between the needle loop lengths and the sinker loop lengths of the non-elastic yarn loops is 0.20 to 0.80.

[6] The weft knit fabric according to any one of [1] to [5] above, wherein the non-elastic yarn forms only a knit structure on the front side and the back side.

[7] The weft knit fabric according to any one of [1] to [6] above, which has a structure in which the elastic yarn alternately repeats a knit structure on either the front side or the back side and a tuck structure on the other side, in the weft direction of the knitted fabric.

[8] The weft knit fabric according to any one of [1] to [7] above, wherein the elastic yarn is coalesced or fused together.

[9] The weft knit fabric according to any one of [1] to [8] above, wherein the elastic yarn and the non-elastic yarn are coalesced or fused together.

[10] The weft knit fabric according to any one of [1] to [9] above, wherein elastic yarn is included in all of the courses of the weft knit fabric.

[11] The weft knit fabric according to any one of [1] to [10] above, wherein the proportion of the number of courses where the non-elastic yarn and elastic yarn are knitted by plating is 50% or lower with respect to the total number of courses.

Advantageous Effects of Invention

The weft knit fabric of the invention has an excellent free-cut property and excellent bending softness.

DESCRIPTION OF EMBODIMENTS

Embodiments of the invention will now be described in detail.

The weft knit fabric of the embodiment comprises non-elastic yarn and elastic yarn and has a front side and a back side, wherein the elastic yarn connects the front side and back side, with the front side and the back side having sections that form needle loops by doubling of the non-elastic yarn and the elastic yarn, and the proportion of the number of sinker loops formed by doubling of the non-elastic yarn and elastic yarn is 50% or lower with respect to the total number of sinker loops of the non-elastic yarn on the front side and the back side.

The weft knit fabric of the embodiment is a weft knit fabric knitted using a weft knitting machine having two or more needle beds, and in most cases it will be knitted with a circular knitting machine. A conventional weft knit fabric exhibits curling due to warping of the loops from the knitted fabric cut sections. The weft knit fabric of the embodiment, however, has a structure in which two knitted fabrics are connected with elastic yarn, and since the two knitted fabrics attempt to warp in opposite directions from the knitted fabric cut sections, they cancel out their warping forces and curling is unlikely to occur.

For this embodiment there is no particular distinction between the front side and back side, and when knitting is with a circular knitting machine, it is sufficient if it has a side knitted by the knitting needle on the cylinder side (cylinder surface), and a side knitted by the knitting needle on the dial side (dial surface).

Figure 1:
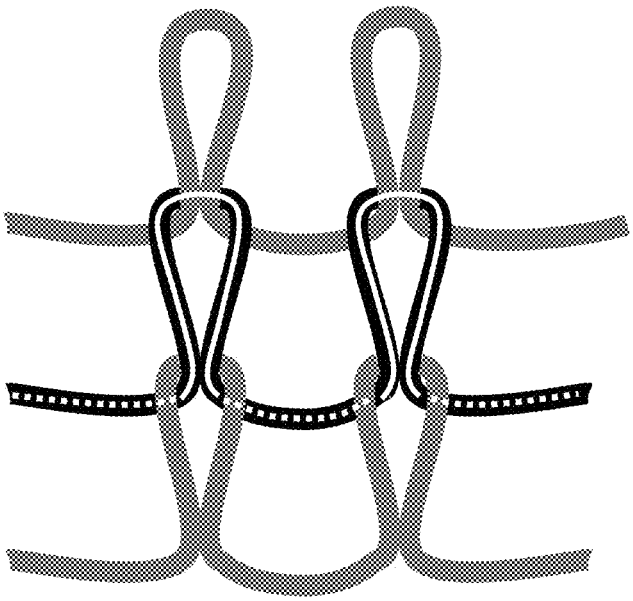
FIG. 1 is a diagram showing the looped state of a knitted form (knit) of warp and weft.

According to the embodiment, a "loop" is either a needle loop or a sinker loop (see FIG. 1). In a tuck structure, the section of an old loop that overlaps with a needle loop is considered to be a needle loop (see FIG. 2). In a miss (welt) structure, the yarn does not touch the needle and therefore no needle loops exist, with all of the loops being sinker loops (see FIG. 3).

The weft knit fabric of the embodiment has sections where non-elastic yarn and elastic yarn form needle loops by doubling. According to the embodiment, "sections where non-elastic yarn and elastic yarn form needle loops by doubling" are sections in which, when non-elastic yarn forms a knit structure or tuck structure, the elastic yarn is also fed through the same needle causing the non-elastic yarn and elastic yarn to become doubled and form a needle loop structure.

Figure 4:
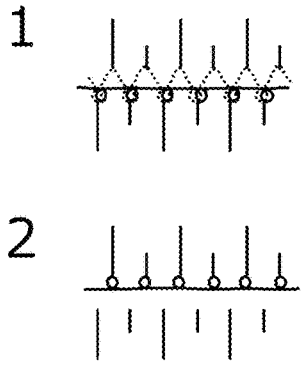
FIG. 4 shows an example of a stitch structure according to an embodiment of the invention.
Figure 4:
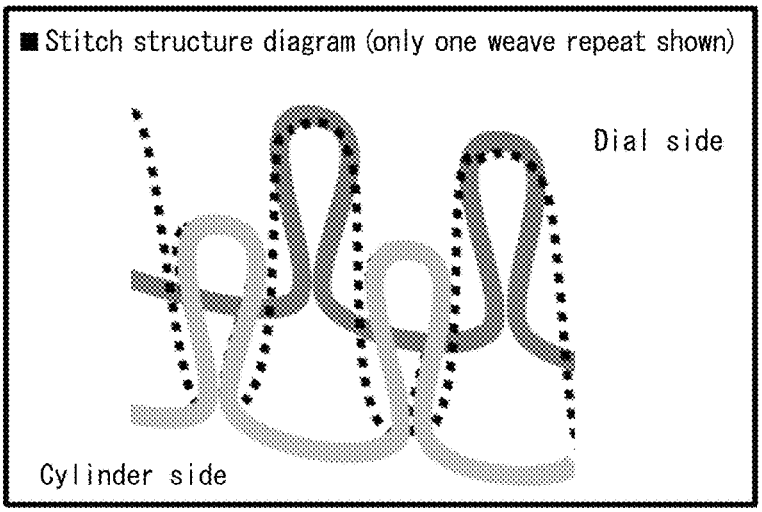

In the weft knit fabric of the embodiment, the proportion of the number of sinker loops formed by doubling of the non-elastic yarn and elastic yarn is preferably 50% or lower with respect to the total number of sinker loops of the non-elastic yarn on the front side and the back side, the proportion being more preferably 25% or lower, and more preferably there are no sections where the non-elastic yarn and elastic yarn form sinker loops by doubling. If the proportion of the number of sinker loops is 50% or lower, there will be no excessive coalescing or fusion of the elastic yarn and non-elastic yarn after heat treatment, and no thickening of the apparent fiber sizes in the sinker loops, resulting in a knitted fabric with excellent bending softness (feel). For example, selecting the cylinder side of the circular knitting machine for an all-needle knit or the dial side of the circular knitting machine for an all-needle tuck, the non-elastic yarn is supplied only to the cylinder side while the elastic yarn is supplied so as to contact the needle on both the cylinder side and dial side, thereby forming a doubled state of the non-elastic yarn and elastic yarn on the cylinder needle, with loops knitted by the knit on the cylinder side forming a structure where only the needle loops are doubled, and since the elastic yarn crosses over to the dial side, a structure is formed in which sinker loops of the non-elastic yarn and elastic yarn do not overlap (see FIG. 4). For this embodiment, the proportion of the number of sinker loops formed by doubling of the elastic yarn other than the elastic yarn connecting the front side and back side (for example, the elastic yarn which is plated on the front side or back side) and the non-elastic yarn is also 50% or lower with respect to the total number of sinker loops of the non-elastic yarn on the front side and back side.

Figure 6:
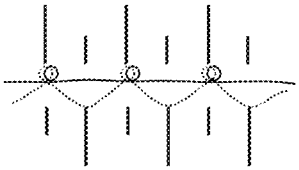
FIG. 6 shows an example of a knitting diagram for a knitted texture according to the embodiment.
Figure 6:
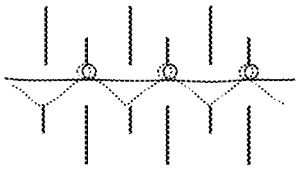
Figure 6:
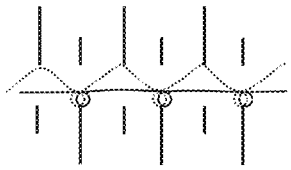
Figure 6:
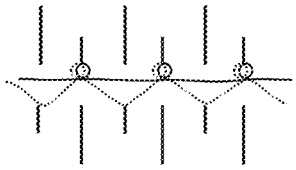

For knitting of a knit structure in which the non-elastic yarn misses one needle on the cylinder side of the circular knitting machine, a knit with a knit structure in which the elastic yarn misses the same needle as the non-elastic yarn on the cylinder side and a knit with a tuck structure in which it misses one needle on the dial side are alternately repeated, forming a structure in which sinker loops of the non-elastic yarn and elastic yarn do not overlap (see FIG. 6).

The relationship between the dial needle and the cylinder needle in knitting with a circular knitting machine may be a rib or an interlock type, and the structure may be selected as appropriate depending on the type.

In other words, the weft knit fabric of the embodiment has sections where the non-elastic yarn and elastic yarn are doubled and sections where they are not doubled in the loops, whereby a free-cut property and bending softness are both obtained. For a plating knit in which non-elastic yarn and elastic yarn are doubled throughout the courses in both the needle loops and sinker loops, the heat set knitted fabric has the non-elastic yarn and elastic yarn fused at all of the needle loops and sinker loops and the apparent fiber sizes of the sinker loops are thickened, resulting in a knitted fabric that is difficult to bend and has an undesirable feel.

The "non-elastic yarn" in the weft knit fabric of the embodiment consists of fiber with a maximum ductility of less than 100%, except for the cases described below. Natural fibers or synthetic fibers may be used as the non-elastic yarn, but there is no particular limitation to these.

Natural fibers include cotton, hemp, silk and wool. Synthetic fibers include polyester fibers such as polyethylene terephthalate and polytrimethylene terephthalate, polyamide fibers such as nylon 6 and nylon 66 and polyolefin fibers such as polyethylene and polypropylene, and their bright threads, semi-dull threads or full dull threads may be selected, while the cross-sectional shapes of the fibers may be any cross-sectional shapes such as round, elliptical, W-shaped, cocoon-shaped or hollow fiber forms, and the form of the fibers is not particularly restricted and may be raw yarn or textured yarn such as false-twisted yarn.

Regenerated (refined) cellulose fibers such as rayon, cupra or lyocell may also be used, and the cellulose fibers may be in the form of single threads as raw yarn or twisted threads, or they may be in the form of composite yarns with the synthetic fibers mentioned below.

The form of the composite yarn is not particularly restricted, and the compositing method may be selected as composite interlacing or combined twisting, for example, depending on the purpose of use. The size for composite yarn of cellulose fiber and synthetic fibers is preferably a size of 19 to 90 dtex, which will allow a knitted fabric to be obtained with excellent bending softness, and a thin form with an excellent wearable feel in hot environments.

For this embodiment, the term "non-elastic yarn" encompasses composite yarn that includes elastic yarn, though with exceptions. The maximum ductility in this case may be 100% or greater. When single covered yarn (SCY) or double covered yarn (DCY) is used, as composite yarn of elastic yarn and synthetic fibers or natural fibers, the total fineness of yarn combined with elastic yarn is preferably 30 to 100 dtex, and from the viewpoint of easier production of the knitted fabric it is more preferably 40 to 80 dtex.

The elastic yarn in the weft knit fabric of this embodiment differs from the synthetic fibers mentioned above, and it consists of fibers with a maximum ductility of 100% or greater. The elastic fiber polymer and spinning process for the elastic yarn are not particularly restricted, and polyurethane-based or polyether ester-based elastic yarn may be used, while dry spinning or melt spinning may be employed in the case of polyurethane-based elastic yarn, for example. Elastic yarn preferably does not impair the stretchability near 180° C., as the normal treatment temperature in preset steps for dyeing. Elastic yarn with functionality such as high settability, a deodorant property or antibacterial properties may also be used, by including special polymers or inorganic powder in the elastic yarn. The size of the elastic yarn is preferably 9 to 80 dtex, and from the viewpoint of easy knitted fabric production it is more preferably 15 to 60 dtex.

From the viewpoint of an improved free-cut property, elastic yarn with a coalescing property or fusibility may be used as the elastic yarn. However, if the desired free-cut property can be obtained by appropriate post-treatment then the elastic yarn does not necessarily need to have a coalescing property or fusibility.

The weft knit fabric of the embodiment has the elastic yarn connecting the front side and back side. If the elastic yarn crosses needle beds on both the front side and back side, then the structure will have the knitted fabric on each side bridged and connected by the elastic yarn. The connection by the elastic yarn may be partial connection of the knitted fabric so long as the structure is one in which the proportion of the number of sinker loops formed by doubling of the non-elastic yarn and elastic yarn is 50% or lower with respect to the total number of sinker loops of the non-elastic yarn see FIG. 14).

From the viewpoint of the free-cut property and especially fray resistance of the weft knit fabric of the embodiment, the proportion of the number of needle loops formed by doubling of non-elastic yarn and elastic yarn is preferably 50% or greater with respect to the total number of needle loops of non-elastic yarn on the front side and back side, and more preferably it is 75% or greater and most preferably 100%. In order to adjust the proportion of the number of needle loops formed by doubling of non-elastic yarn and elastic yarn with respect to the total number of needle loops of non-elastic yarn on the front side and back side, so that each is the desired proportion, the structure may be designed with 1 needle unit for a jacquard knitting machine, or for a non-jacquard knitting machine, the number of courses or wales in one weave repeat may be increased or decreased. One weave repeat refers to the minimum repeat of course numbers and wale numbers in the knitted texture composing the knitted fabric, and for example, the structure shown in FIG. 11 has 2 courses and 4 wales as one weave repeat.

Non-elastic yarn that is not doubled with elastic yarn in a knitted fabric is usually easy to pull out by washing friction or by contact with a sharp object. Yarn pulled out in a knitted fabric cut section not only impairs the aesthetic appearance but also results in frayed yarn contacting with the skin and causing a tingling or itching feel, which greatly impairs the wearable feel. For a free-cuttable knitted fabric, therefore, it is extremely important for the knitted fabric cut sections to have no fraying. If the proportion of the number of needle loops formed by doubling of non-elastic yarn and elastic yarn with respect to the total number of needle loops of non-elastic yarn on the front side and back side is within the aforementioned preferred range, fraying at the cut sections will be reduced, and therefore the non-elastic yarn that is not doubled with elastic yarn will not be pulled out even when elongated or impacted by load during washing or other activities, and the knitted fabric will have an excellent free-cut property and also an excellent wearable feel.

In the weft knit fabric of the embodiment, preferably the non-elastic yarn that forms one side does not connect with the other side. Since the structure is such that the non-elastic yarn forming one side does not connect with the other side, a circular knitting machine with two or more needle beds may be appropriately selected and a knitted fabric weave may be knitted in each needle bed without the non-elastic yarn moving between needle beds. In the weft knit fabric of the embodiment, the non-elastic yarn composing one side does not connect to the other side, thus allowing an excellent feel with bending softness to be obtained even with thin fabrics, and allowing a free-cuttable knitted fabric to be obtained. In addition, by changing the type of non-elastic yarn composing each side it is possible to provide different functions on the front and back of the weft knit fabric or to obtain a free-cuttable knitted fabric having an excellent design property with different designs on the front and back.

From the viewpoint of the free-cut property and especially fray resistance of the weft knit fabric of the embodiment, when it is elongated with a load of 9.8 N with both the warp and weft, the ratio between the needle loop lengths and the sinker loop lengths (sinker loop length/needle loop length) of the non-elastic yarn loops in the same course is preferably 0.20 to 0.80 and more preferably 0.25 to 0.65. In the case of a knitted fabric in which the structure differs depending on the course, the ratio of the course with the greatest ratio is used. If the ratio of the loop length is in the preferred range, fraying at the cut sections will be reduced, and therefore the non-elastic yarn that is not doubled with elastic yarn will not be pulled out even when elongated or impacted by load during washing or other activities, resulting in an excellent free-cuttable knitted fabric which also exhibits an excellent wearable feel with stretchability to follow movement of the body.

In order to adjust the loop length ratio, the density during knitting may be adjusted, and a proper knitting machine gauge may be selected according to the size.

Measurement of the loop length ratio will be described in detail in the Examples, but after the knitted fabric has been elongated with a stress of 9.8 N in each of the warp and weft directions and anchored with a pin frame, it is measured with a microscope to determine the needle loop length at 9.8 N elongation and the sinker loop length at 9.8 N elongation. This method allows measurement of the knitted fabric without destroying it.

In the weft knit fabric of the embodiment, preferably the non-elastic yarn forms only a knit structure on the front side and back side. If the non-elastic yarn only forms a knit structure, unevenness in the feel will be reduced and the front and back will be smooth, allowing a knitted fabric with excellent bending softness and greater suitability as underwear to be obtained.

Figure 5:
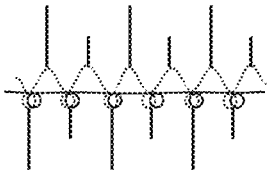
FIG. 5 shows an example of a knitting diagram for a knitted texture according to the embodiment.
Figure 5:
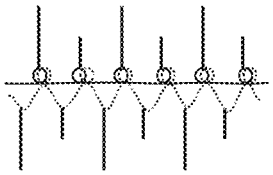
Figure 10:
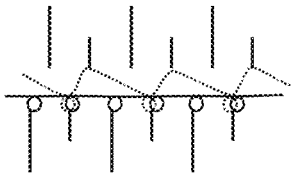
FIG. 10 shows an example of a knitting diagram for a knitted texture according to the embodiment.
Figure 10:
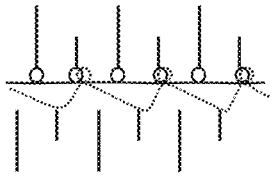

From the viewpoint of the free-cut property and bending softness, the weft knit fabric of the embodiment preferably has a structure in which the elastic yarn is in a knit structure on either the front side or back side and a tuck structure to the other side, repeating in an alternating manner in the weft direction of the knitted fabric. In the weft knit fabric of the embodiment, the knit structure and tuck structure formed by the elastic yarn on the front side and the back side may have needle skipping as shown in FIG. 6 and FIG. 10, or no needle skipping as shown in FIG. 5, but from the viewpoint of the free-cut property it preferably has no needle skipping.

From the viewpoint of the free-cut property, the weft knit fabric of the embodiment preferably has coalescing or fusion between the elastic yarn, and more preferably it also coalescing or fusion between the non-elastic yarn and elastic yarn, as well as between the elastic yarn. The term "coalescing or fusion" means that one or both yarns are integrated by melting or shaping, making the yarns difficult to move.

For coalescing or fusion between the elastic yarn, dry heat setting may be carried out in a range of 150° C. to 210° C., or moist heat setting may be carried out at a temperature of 90° C. or higher.

From the viewpoint of the free-cut property, the knitted fabric of the embodiment preferably includes elastic yarn in all of the courses.

The method of supplying the non-elastic yarn and elastic yarn to the needle cushion is not particularly restricted and may be any appropriate method. Regardless of the knitting method there is no change in the knitted fabric obtained so long as it has the structure of the embodiment, and it is possible to obtain a knitted fabric wherein the proportion of the number of sinker loops formed by doubling of non-elastic yarn and elastic yarn is 50% or lower with respect to the total number of sinker loops of the non-elastic yarn, and with bending softness.

When the knitted fabric is to be used as clothing, the weft direction of the knitted fabric (the course direction) will generally be the weft direction of the product. In order to obtain a knitted fabric with a satisfactory feel and which tends to follow body movement or the body shape when it is worn, it is important for the knitted fabric to have bending softness in the weft direction (softness when it is folded so that a crease forms in the warp direction (wale direction) of the knitted fabric). A knitted fabric with a soft feel is particularly desired when it is to be used as underwear. In order to obtain a knitted fabric with a soft feel it is especially important to have high bending softness. The bending softness will be described in detail below, but it can be evaluated by measuring the flexural rigidity with a KES-FE2-AUTO-A Automatic Pure Bending Tester by Kato Tech Corp. The flexural rigidity measured with such a tester is preferably in the range of 0.0020 $cN \cdot cm^2/cm$ to 0.0200 $cN \cdot cm^2/cm$ and even more preferably 0.0020 $cN \cdot cm^2/cm$ to 0.0180 $cN \cdot cm^2/cm$, as a value within this range will result in a knitted fabric having a soft feel and an excellent wearable feel that follows curving or movement of the body. Since the proportion of the number of sinker loops formed by doubling of non-elastic yarn and elastic yarn is 50% or lower with respect to the total number of sinker loops of the non-elastic yarn in the structure of the embodiment, it is possible to adequately obtain flexural rigidity in the preferred range. In addition, by reducing the monofilament size of the non-elastic yarn or selecting a large gauge for the yarn size to widen the spacing between needle loops and obtain a more coarse structure, it is possible to further increase the bending softness.

In the weft knit fabric of the embodiment, the loop length ratio between the non-elastic yarn loop length and the elastic yarn loop length (non-elastic yarn loop length/elastic yarn loop length) in the same course is preferably 1.0 to 3.0. If the ratio between the non-elastic yarn loop length and elastic yarn loop length in the same course is in this range, connection between the knitted fabric on the front and back will be made with appropriate tensile force, and a knitted fabric with more suitable wear stretchability can be obtained. If the loop length ratio is 1.0 or greater, the tensile force of the elastic yarn will be adequately high with firm connection between the front and back, shifting between the front and back fabrics will be unlikely to occur during washing or other activity, and the outer appearance will be satisfactory with less wrinkling. The non-elastic yarn loop length and elastic yarn loop length ratio for the same course can be adjusted by adjusting the density or thread feed amount, or by other appropriate adjustments such as changing the spacing between needle beds. For this embodiment, the length of each thread per 100 wales in a single course of the disassembled knitted fabric is considered to be the loop length, with the units expressed as mm/100 w. In the case of a knitted fabric in which the structure differs depending on the course, the ratio in the course with the greatest ratio is used.

The weft knit fabric of the embodiment has a stress of preferably 150 cN or lower and more preferably 130 cN or lower with 40% elongation in the weft direction of the knitted fabric. If the stress at 40% elongation in the weft direction of the knitted fabric is 150 cN or lower, then it will be possible to obtain a soft-stretch knitted fabric which can be comfortably worn without a feeling of tightness even when the knitted fabric has been stretched while being worn, and which has recoverability allowing it to be fitted without excess, thereby avoiding impairment of the outer appearance. This effect is even greater if the stress at 40% elongation is 130 cN or lower in both the warp and weft directions of the knitted fabric.

In order to achieve the preferred range for the bending softness and the stretching force at 40% elongation in the weft direction of the knitted fabric, the ratio between the needle loop length of the non-elastic yarn at maximum elongation and the sinker loop length of the non-elastic yarn at maximum elongation of the knitted fabric may be limited to 0.20 to 0.80, or the ratio of the non-elastic yarn loop length and elastic yarn loop length in the same course may be adjusted to the range of 1.0 to 3.0.

The basis weight of the weft knit fabric of this embodiment is preferably 70 g/m$^2$ to 180 g/m$^2$ and more preferably 70 g/m$^2$ to 160 g/m$^2$. If the basis weight is 70 g/m$^2$ or greater, the rupture strength in the case of use for clothing will be improved and the knitted fabric will have no problems for actual wearing. If the basis weight is 180 g/m$^2$ or lower the knitted fabric will not become too thick, and therefore the resulting knitted fabric will have a soft feel and wearing suitability for underwear.

The thickness of the weft knit fabric of the embodiment is preferably 0.30 mm to 1.00 mm and more preferably 0.40 mm to 0.90 mm. If the thickness is 0.30 mm or greater, problems of see-through visibility or strength during wear can be avoided, and if it is 1.00 mm or lower the basis weight will not be too high and thickness can be avoided, so that when it is used as underwear the knitted fabric will be resistant to mustiness resistance, and will have satisfactory skin contact and a satisfactory feel.

The circular knitting machine used to obtain the weft knit fabric of the embodiment is not particularly restricted, and the gauge of the knitting machine is also freely selectable, although a knitting machine with a gauge of about 24 to 50 is preferably used. If the gauge is 24 or higher, the needle size will be sufficiently small to allow knitting of a knitted fabric comprised of small stitches using fine yarn, and the resulting knitted fabric will have a smooth surface with a pleasant feel on the skin, as well as low thickness with a satisfactory aesthetic appearance. If the gauge is 50 or lower, it will be possible to prevent the loop size from being too small, and suitable stretch properties can be imparted without creating a feeling of stress when worn.

The weft knit fabric of this embodiment may also be dyed. The method of producing a dye finish may employ common dye finishing steps, under dyeing conditions suited for the fiber materials used, and the dyeing machine used may be a jet dyeing machine, winch dyeing machine or paddle dyeing machine. Finishing agents used to improve the water absorption and softness may also be used. Softeners that are used may be silicon-based, urethane-based or ester-based softeners, at concentrations appropriately selected depending on the desired feel for the knitted fabric, with a range of 0.1% owf to 2.0% owf resulting in satisfactory bending softness and lowering friction between stitches, thus allowing better soft-stretch properties and recoverability to be exhibited.

From the viewpoint of bending softness (feel), in the weft knit fabric of the embodiment the proportion of the number of courses where the non-elastic yarn and elastic yarn are knitted by plating with respect to the total number of courses is preferably 50% or lower and more preferably 25% or lower.

EXAMPLES

The invention will now be explained in greater detail by examples. It is naturally understood, however, that the invention is not limited to these examples.

The following measurement methods were used for the property values in the Examples. Knitted fabrics used for measurement include knitted fabrics cut out from clothing, but the uses of the knitted fabric are not limited to clothing.

Figure 2:
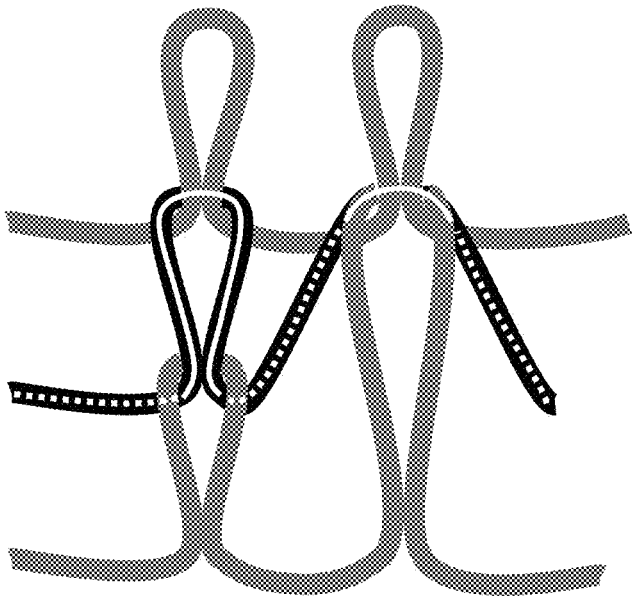
FIG. 2 is a diagram showing the looped state of a knitted form (tuck) of warp and weft.
Figure 3:
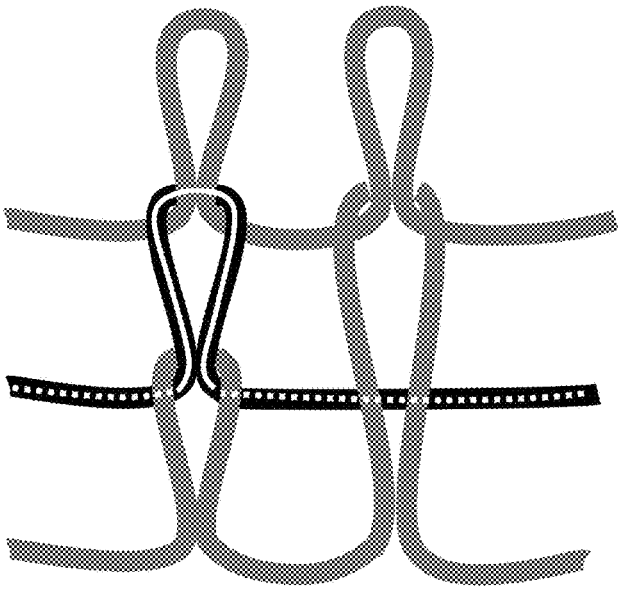
FIG. 3 is a diagram showing the looped state of a knitted form (miss (welt)) of warp and weft.

(1) Proportion of Number of Needle Loops Formed by Doubling of Non-Elastic Yarn and Elastic Yarn with Respect to Total Number of Needle Loops of Non-Elastic Yarn, and Proportion of Number of Sinker Loops Formed by Doubling of Non-Elastic Yarn and Elastic Yarn with Respect to Total Number of Sinker Loops of Non-Elastic Yarn The proportion of the number of needle loops formed by doubling of non-elastic yarn and elastic yarn with respect to the total number of needle loops of non-elastic yarn was calculated by selecting any one weave repeat in the knitted fabric, visually measuring the total number of needle loops of non-elastic yarn and the number of needle loops formed by doubling of non-elastic yarn and elastic yarn, and dividing the latter by the former. For the embodiment, a "needle loop" is a knit structure and tuck structure as shown in FIG. 1 to FIG. 3. A "needle loop formed by doubling of non-elastic yarn and elastic yarn" refers to a needle loop wherein the non-elastic yarn and elastic yarn are doubled to form a needle loop structure. A loop where only elastic yarn forms a knit or tuck is not counted as being formed by doubling of non-elastic yarn and elastic yarn. The proportion of the number of sinker loops formed by doubling of non-elastic yarn and elastic yarn with respect to the total number of sinker loops of the non-elastic yarn is also measured and calculated in the same manner as the proportion of the number of needle loops formed by doubling of non-elastic yarn and elastic yarn with respect to the total number of needle loops of non-elastic yarn.

(2) Proportion of Number of Courses where Non-Elastic Yarn and Elastic Yarn are Knitted by Plating, with Respect to Total Number of Courses The total number of courses in the one weave repeat selected in (1) and the number of courses where the non-elastic yarn and elastic yarn are knitted by plating in the same weave repeat are measured, and the value of the latter divided by the former is calculated. A "course where non-elastic yarn and elastic yarn are knitted by plating" is a course in which non-elastic yarn and elastic yarn are knitted in the same structure in both a needle loop and sinker loop in the same course.

(3) Ratio Between Needle Loop Lengths and the Sinker Loop Lengths of Non-Elastic Yarn Using a 30 cm-wide chuck, a knitted fabric held at 30 cm square between the chuck was stretched at a stress of 9.8 N in the warp and weft while anchoring it with a rectangular pin frame (inner dimension: 27 cm×24 cm, thickness: 1.5 cm) in both the warp and weft directions, and then a microscope (VHX-6000 by Keyence Corp.) was used to photograph the front and back of the knitted fabric at an arbitrary magnification. In the photographed image, one weave repeat of the knitted fabric was arbitrarily selected near the center within the pin frame, and the loop length was measured as described below for the non-elastic yarn of all of the courses of the one weave repeat. With one end of an arbitrary needle loop of non-elastic yarn as the origin, and 1 set being from end to end of the needle loop and from end to end of the following sinker loop, the total needle loop length and total sinker loop length of 10 continuous sets in the course direction were measured and divided by the number of sets (10) to calculate the needle loop and sinker loop length of the non-elastic yarn. The loop length was measured using "free line measurement" as the basic measuring function of the microscope, moving the measuring cursor through the center of the yarn along the shape of the loop and measuring from the traveling distance of the cursor. The needle loop and sinker loop were measured with the solid line as the needle loop and the dotted line as the sinker loop, as shown in FIG. 1 to FIG. 3.

The ratio between the needle loop lengths and the sinker loop lengths in the non-elastic yarn loops are calculated from the needle loop length and sinker loop length of the non-elastic yarn in all of the courses of the measured one weave repeat, according to the following formula:

Ratio between needle loop lengths and sinker loop lengths of non-elastic yarn=Needle loop length of non-elastic yarn/sinker loop length of non-elastic yarn.

The largest value among the ratio between the needle loop lengths and the sinker loop lengths of the non-elastic yarn in all of the courses of the one weave repeat that were calculated in this manner was recorded as the needle loop length and sinker loop length ratio for the non-elastic yarn of the knitted fabric.

(4) Ratio Between Non-Elastic Yarn Loop Length and Elastic Yarn Loop Length in Same Course In one arbitrary weave repeat of the knitted fabric, for all of the courses of the one weave repeat, a range of 100 wales was cut in each course and disassembled, extracting the non-elastic yarn and elastic yarn, and the loop lengths were measured by the following method in a standard environment of 20° C., 50% RH.

Non-elastic yarn: One end of a non-elastic yarn obtained by disassembling is anchored and the fabric is suspended, and then a predetermined load suited for the type of yarn as described below is attached to the other end and the length after 30 seconds is measured. The units are expressed in mm/100 w. The loop length is also measured by this method for composite yarns comprising non-elastic yarn and elastic yarn.

<Load According to Yarn Type>

For synthetic fiber elastic bulk yarns and composite yarns of non-elastic yarn and elastic yarn: 8.82 mN/dtex For other non-elastic yarns: 2.94 mN/dtex Elastic yarn: One end of an elastic yarn thread obtained by disassembling is anchored and the fabric is suspended, and upon confirming that the elastic yarn is essentially straight linear, the length in that state is measured. The units are expressed in mm/100 w.

The ratio between the non-elastic yarn loop length and elastic yarn loop length in the same course is calculated from the non-elastic yarn and elastic yarn loop length in 100 wales of all of the courses of the one measured weave repeat, according to the following formula:

Ratio between non-elastic yarn loop length and elastic yarn loop length in same course=Non-elastic yarn loop length/elastic yarn loop length.

The largest value among the ratio between the needle loop lengths and the sinker loop lengths of the non-elastic yarn in the 100 wales in all of the courses of the one weave repeat that were calculated in this manner is recorded as the needle loop length and sinker loop length ratio for the non-elastic yarn of the knitted fabric.

(5) Basis Weight (g/m$^2$)

The knitted fabric basis weight is measured according to Mass Per Unit Area, Method A (JIS), under the standard conditions of JIS-L-1096.

(6) Thickness (mm)

The thickness of the knitted fabric is measured at 3 arbitrary locations of the knitted fabric using a knitted fabric thickness gauge by Peacock Co., and the average of the three locations is calculated.

(7) Stitch Density

Number of wales: The number of needle loops per 1-inch in the weft direction (course direction) of the knitted fabric is measured. For knitted fabrics containing mesh parts, the number of needle loops may differ for each course depending on the knitted fabric structure, in which case the number of wales is the number of needle loops in the course with the greatest number of needle loops, and the units used are wale/inch (w/inch (2.54 cm)).

Number of courses: The number of needle loops per 1-inch in the warp direction (wale direction) of the knitted fabric is measured. For knitted fabrics containing mesh parts, the number of needle loops may differ for each wale depending on the knitted fabric texture, in which case the number of wales is the number of needle loops in the wale with the greatest number of needle loops, and the units used are course/inch (c/inch).

(8) Bending Softness (Flexural Rigidity) of Weft Direction of the Knitted Fabric A KES-FE2-AUTO-A Automatic Pure Bending Tester by Kato Tech Corp. is used for the measurement. A knitted fabric cut to 20.0 cm width×20.0 cm length is used as the test piece. For measurement of the flexural rigidity in the weft direction of the knitted fabric (the hardness of the knitted fabric when folded so that a crease forms in the warp direction of the knitted fabric), the test piece is placed on the sample stage so that the cut section in the warp direction of the knitted fabric is at the back of the sample stage, inserting it toward the back until the sample insertion location indicating lamp lights up, and then conducting measurement. The measuring sensitivity for the Examples was 4.0 gf cm/10 V, but this may be appropriately adjusted in the range of 4.0 to 50.0 gf cm/10 V depending on the degree of flexural rigidity of the test piece. The upward bending flexural rigidity and the downward bending flexural rigidity of the knitted fabric are measured in the tester, and the average value is recorded. The test is conducted for three test pieces and the average is calculated. Since the tester outputs in units of gf·cm$^2$/cm, the result was multiplied by 0.980665 for conversion to cN·cm$^2$/cm.

A smaller flexural rigidity value indicates a softer knitted fabric, better following of body curvature and movement, and a more excellent feel. For the Examples, a flexural rigidity of 0.0200 cN·cm$^2$/cm or lower was judged as bending softness, and a value of 0.0180 cN·cm$^2$/cm or lower was judged as excellent bending softness.

(9) Stress at 40% Elongation (Load, cN)

Using a tensile tester, a knitted fabric cut out to 2.5 cm width×15 cm length is gripped at both ends of the knitted fabric at 2.5 cm widths. Gripping is with an interval of 10 cm between gripping parts, and the procedure of stretching from an elongation percentage of 0% to 80% at a rate of 300 mm/min followed by recovery from an elongation percentage of 80% to 0% is repeated 3 times, with the stress with an elongation percentage of 40% at the third elongation being recorded as the stress at 40% elongation.

(10) Free-Cut Property

The free-cut property is evaluated from the two viewpoints of (a) cut section curling and (b) fray resistance.

[(a) Cut Section Curling]

<Cut Section Curling in Weft Direction of Knitted Fabric>

Figure 21:
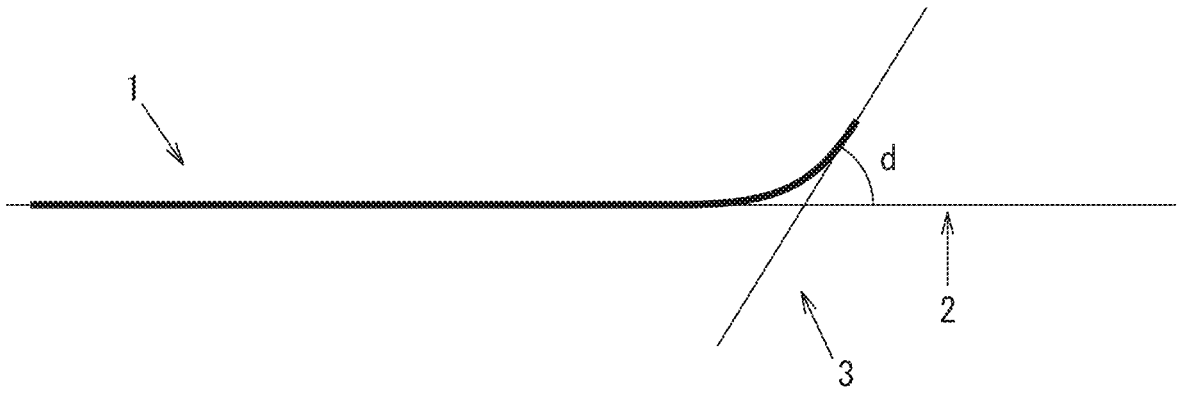
FIG. 21 is a diagram illustrating a method of measuring curling of a knitted fabric according to the embodiment.

A rectangular knitted fabric cut to 10 cm in the weft direction and 2.5 cm in the warp direction was used as the test piece and placed on a horizontal desk. Both short sides were then gripped with the fingers at a width of about 1.5 cm and stretched until the 10 cm long sides reached 15 cm (50% elongation), and the angle of curling at the center of each long side of the test piece during elongation was measured as the curl angle (d) of crossing between a straight line (2) contacting the horizontal knitted fabric (1) and a straight line (3) contacting about 3 mm at the edge of the knitted fabric during 50% elongation, as shown in FIG. 21.

<Cut Section Curling in Warp Direction of Knitted Fabric>

A rectangular knitted fabric cut to 10 cm in the warp direction and 2.5 cm in the weft direction was used as the test piece and placed on a horizontal desk. Both short sides were then gripped with the fingers at a width of about 1.5 cm and stretched until the 10 cm long sides reached 15 cm (50% elongation), and the angle of curling at the center of each long side of the test piece during elongation was measured as the curl angle (d) of crossing between a straight line (2) contacting the horizontal knitted fabric (1) and a straight line (3) contacting about 3 mm at the edge of the knitted fabric during 50% elongation, as shown in FIG. 21.

While a curl angle of 60° or smaller permits use in a free-cut clothing, with an angle of 30° or smaller curling becomes virtually unnoticeable, allowing even greater suitability for free-cut clothing, and an angle of 5° or smaller is even more preferred because it results in an excellent aesthetic appearance without affecting outer clothing and without discomfort caused by skin contact at the edges.

[(b) Fray Resistance]

The fray resistance was evaluated for washed knitted fabrics of the Examples.

After cutting the knitted fabric to a rectangular shape of 20.0 cm in the weft direction of the knitted fabric and 10.0 cm in the warp direction, a 5.0 cm notch was formed at the center of each angle dividing it equally into 45° sections, for use as a test piece. One test piece and a dummy cloth conforming to JIS L 1930 appendix H, type III in an amount to adjust the total of the test piece and dummy cloth to 1.0 kg, were washed together for 15 minutes×50 times in hot water at 40° C. using a household washing machine, and the test piece was flat-dried. On both the long side (knitted fabric weft direction) and short side (knitted fabric warp direction) of the dried test knitted fabric, the cut sections at the notches (45° direction of the knitted fabric) were observed and evaluated on the following scale, with grade 3 or higher being judged as usable for free-cut clothing, and grade 4 or higher being judged as excellent fray resistance.

Grade 5: No frayed sections protruding at ≥2.0 mm from the cut section

Grade 4: 1 to 5 frayed sections protruding ≥2.0 mm from the cut section, per 2.54 cm Grade 3: 6 to 10 frayed sections protruding ≥2.0 mm from the cut section, per 2.54 cm Grade 2: 11 to 20 frayed sections protruding ≥2.0 mm from the cut section, per 2.54 cm Grade 1: ≥21 frayed sections protruding ≥2.0 mm from the cut section, per 2.54 cm Since fray resistance is generally judged by determining the presence or absence of fraying upon stretching the knitted end section of the knitted fabric immediately after cutting, fraying may occur when the knitted fabric is subjected to a load such as washing or drying during actual use of a product. Evaluation of a knitted fabric immediately after cutting is therefore insufficient, and for clothing in which the edges are to be used in free-cut form it is important that fraying does not occur even after washing. With this in mind, the fray resistance for the Examples was evaluated for the knitted fabrics after washing, so that fraying was judged under more severe conditions.

(11) Wearable Feel

A short sleeve inner wear piece for the upper body was sewed using a knitted fabric obtained in each of the Examples and Comparative Examples, and was worn by a monitor, with a white shirt also being worn after putting on short sleeve inner wear. After sitting stationary on a chair for 5 minutes after putting on the clothing, in an environment of 28° C., 50% RH to simulate commuting to work in early summer, a treadmill was used for 20 minutes of walking at a speed of 4.5 km/hr. The wearable feel from putting on the inner wear until the walking period was completed was subjectively evaluated according to the two properties of: [1: comfort when worn], and [2: skin contact at edges], based on the 5-level evaluation scale shown below. The test was conducted by 10 monitors, and the average value for each property was recorded as the evaluation result. The average value was rounded up to two decimal places and the first decimal place was calculated. An average of 4.0 or greater was judged to be excellent wearability or comfort. Comfort during wear is especially important for underwear with an excellent feel, and while skin contact at the edges is also important, comfort should be achieved as a priority.

[Property 1: Comfort when Worn]

The wearing comfort was evaluated on the following 5-level scale from the viewpoint of feeling of tightness, smoothness of skin contact, movement shape-following property and general feel.

5 points: Very comfortable 4 points: Comfortable 3 points: No particular discomfort 2 points: Uncomfortable 1 point: Very uncomfortable

[2: Skin Contact at Edges]

The wearing comfort was evaluated on the following 5-level scale from the viewpoint of skin contact at the edges.

5 points: Very comfortable 4 points: Comfortable 3 points: No particular discomfort 2 points: Uncomfortable 1 point: Very uncomfortable The different types of yarn used in the Examples, Comparative Examples and tables are abbreviated as follows.

Nylon: Ny

Polyester: Es

Cupra: Cu

Polyurethane elastic yarn: Pu

The units for the number of filaments are denoted as "f".

Unless otherwise specified, the polyurethane elastic yarn used was bare.

Example 1

A knitted fabric was knitted with the knitting diagram shown in FIG. 5 using a 32 gauge double circular knitting machine, with the following yarns.

[Cylinder Side and Dial Side]

Non-elastic yarn: Ny, 33 dtex/26 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 1 and 2 below.

Example 2

A knitted fabric was knitted with the knitting diagram shown in FIG. 5 using a 28 gauge double circular knitting machine, with the following yarns.

[Cylinder Side and Dial Side]

Non-elastic yarn: Ny, 44 dtex/34 f, raw yarn

Elastic yarn: Pu, 22 dtex

The knitted fabric was relaxed and scoured with a continuous scouring machine, and then preset for 1 minute at 185° C. Dyeing was carried out with addition of the softener NICEPOLE PRN (product of Nicca Chemical Co., Ltd.) at 0.5% owf during dyeing, and then finish setting was carried out under conditions of 170° C., 1 minute and the obtained knitted fabric was used for sewing of a short sleeve inner wear piece, which was evaluated. The evaluation results are shown in Tables 1 and 2 below.

Example 3

A knitted fabric was knitted with the knitting diagram shown in FIG. 5 using a 36 gauge double circular knitting machine, with the following yarns.

[Cylinder Side and Dial Side]

Non-elastic yarn: Ny, 44 dtex/34 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 1 and 2 below.

Example 4

A knitted fabric was knitted with the knitting diagram shown in FIG. 5 using a 28 gauge double circular knitting machine, with the following yarns.

[Cylinder Side]

Non-elastic yarn: Es, 56 dtex/34 f, raw yarn

Elastic yarn: Pu, 22 dtex

[Dial Side]

Non-elastic yarn: composite yarn (Ny, 22 dtex/13 f+Cu, 33 dtex/26 f)

Elastic yarn: Pu, 22 dtex

The knitted fabric was relaxed and scoured with a continuous scouring machine, and then preset for 1 minute at 190° C. Dyeing was carried out with addition of the softener NICEPOLE PRN (product of Nicca Chemical Co., Ltd.) at 0.5% owf during dyeing, and then finish setting was carried out under conditions of 170° C., 1 minute and the obtained knitted fabric was used for sewing of a short sleeve inner wear piece, which was evaluated. The evaluation results are shown in Tables 1 and 2 below.

Example 5

A knitted fabric was knitted with the knitting diagram shown in FIG. 6 using a 28 gauge double circular knitting machine, with the following yarns.

[Cylinder Side and Dial Side]

Non-elastic yarn: Ny, 33 dtex/36 f, false-twisted

Elastic yarn: Pu, 22 dtex

The knitted fabric was relaxed and scoured with a continuous scouring machine, and then preset for 1 minute at 190° C. Dyeing was carried out with addition of the softener NICEPOLE PRN (product of Nicca Chemical Co., Ltd.) at 0.5% owf during dyeing, and then finish setting was carried out under conditions of 170° C., 1 minute and the obtained knitted fabric was used for sewing of a short sleeve inner wear piece, which was evaluated. The evaluation results are shown in Tables 1 and 2 below.

Example 6

Figure 7:
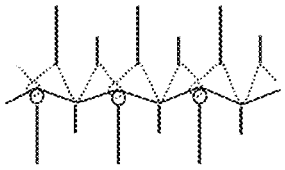
FIG. 7 shows an example of a knitting diagram for a knitted texture according to the embodiment.
Figure 7:
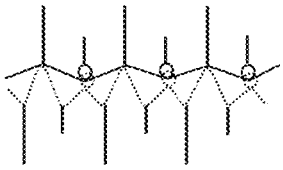
Figure 7:
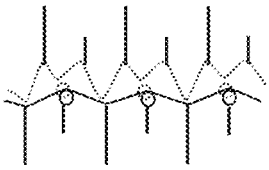
Figure 7:
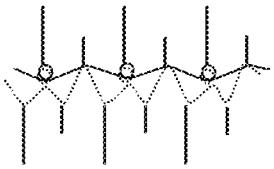

A knitted fabric was knitted with the knitting diagram shown in FIG. 7 using a 28 gauge double circular knitting machine, with the following yarns.

[Cylinder Side and Dial Side]

Non-elastic yarn: Ny, 33 dtex/26 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 1 and 2 below.

Example 7

Figure 8:
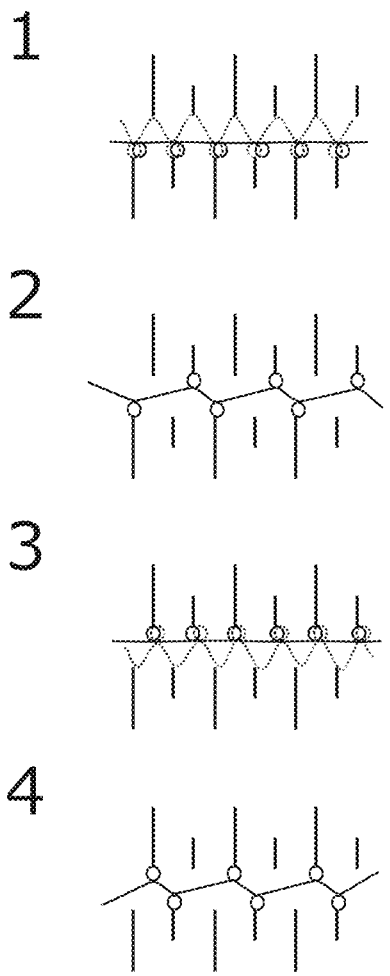
FIG. 8 shows an example of a knitting diagram for a knitted texture according to the embodiment.

A knitted fabric was knitted with the knitting diagram shown in FIG. 8 using a 28 gauge double circular knitting machine, with the following yarns.

[Cylinder Side and Dial Side]

Non-elastic yarn: Ny, 33 dtex/26 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 1 and 2 below.

Example 8

Figure 9:
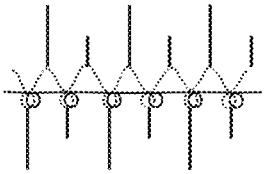
FIG. 9 shows an example of a knitting diagram for a knitted texture according to the embodiment.
Figure 9:
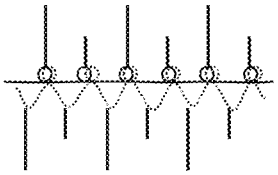
Figure 9:
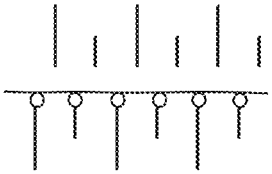
Figure 9:
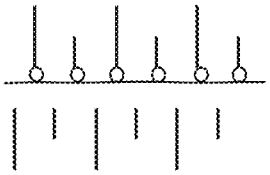

A knitted fabric was knitted with the knitting diagram shown in FIG. 9 using a 28 gauge double circular knitting machine, with the following yarns.

[Cylinder Side and Dial Side]

Non-elastic yarn: Ny, 33 dtex/26 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 1 and 2 below.

Example 9

A knitted fabric was knitted with the knitting diagram shown in FIG. 10 using a 28 gauge double circular knitting machine, with the following yarns.

[Cylinder Side and Dial Side]

Non-elastic yarn: Ny, 44 dtex/34 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 1 and 2 below.

Example 10

Figure 11:
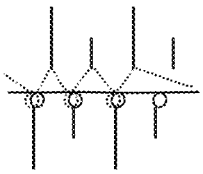
FIG. 11 shows an example of a knitting diagram for a knitted texture according to the embodiment.
Figure 11:
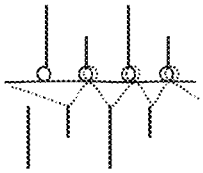

A knitted fabric was knitted with the knitting diagram shown in FIG. 11 using a 28 gauge double circular knitting machine, with the following yarns.

[Cylinder Side and Dial Side]

Non-elastic yarn: Ny, 44 dtex/34 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-1 and 4 below.

Example 11

Figure 12:
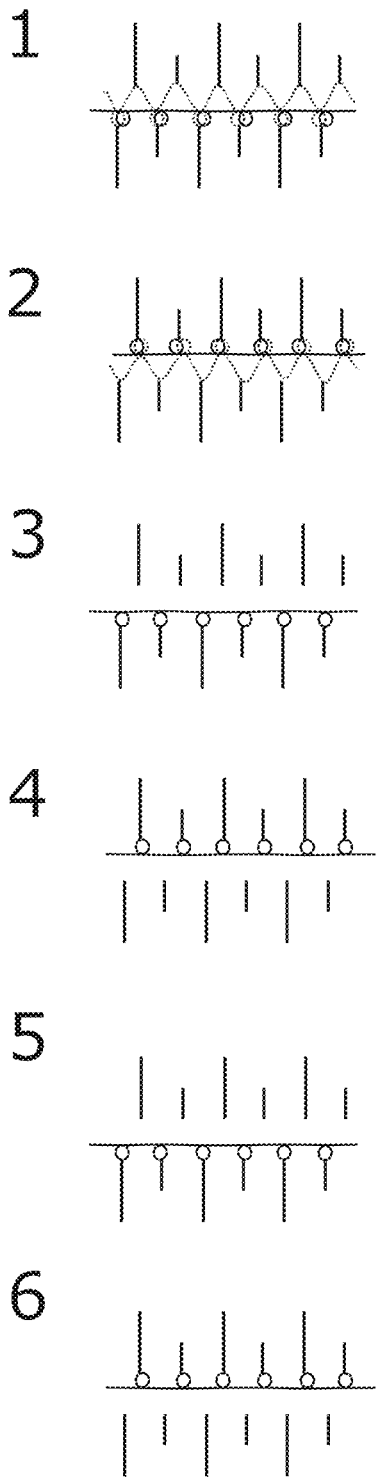
FIG. 12 shows an example of a knitting diagram for a knitted texture according to the embodiment.

A knitted fabric was knitted with the knitting diagram shown in FIG. 12 using a 40 gauge double circular knitting machine, with the following yarns.

[Cylinder Side and Dial Side]

Non-elastic yarn: Ny, 13 dtex/7 f, raw yarn

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-1 and 4 below.

Example 12

Figure 13:
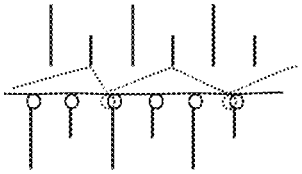
FIG. 13 shows an example of a knitting diagram for a knitted texture according to the embodiment.
Figure 13:
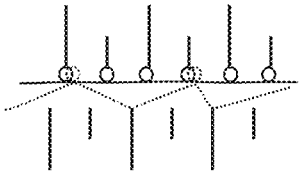

A knitted fabric was knitted with the knitting diagram shown in FIG. 13 using a 40 gauge double circular knitting machine, with the following yarns.

[Cylinder Side and Dial Side]

Non-elastic yarn: Ny, 13 dtex/7 f, raw yarn

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-1 and 4 below.

Example 13

Figure 14:
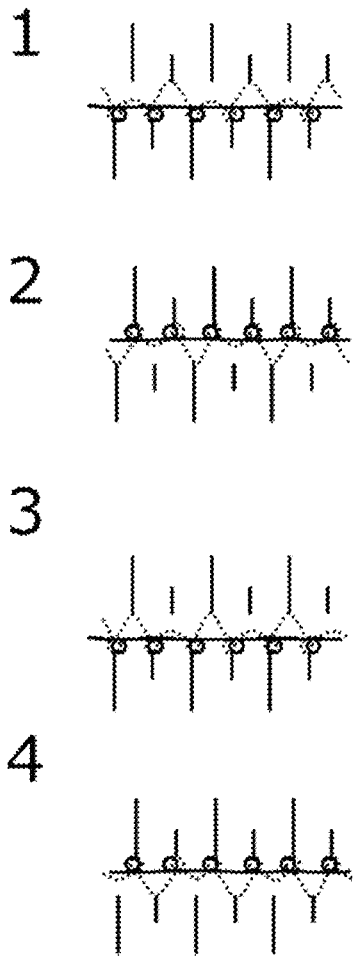
FIG. 14 shows an example of a knitting diagram for a knitted texture according to the embodiment.

A knitted fabric was knitted with the knitting diagram shown in FIG. 14 using a 32 gauge double circular knitting machine, with the following yarns.

[Cylinder Side and Dial Side]

Non-elastic yarn: Ny, 33 dtex/26 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-1 and 4 below.

Example 14

Figure 15:
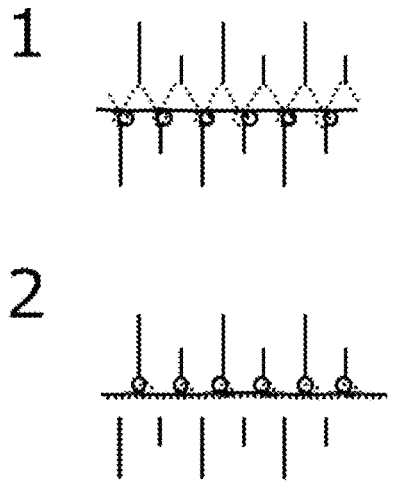
FIG. 15 shows an example of a knitting diagram for a knitted texture according to the embodiment.

A knitted fabric was knitted with the knitting diagram shown in FIG. 15 using a 32 gauge double circular knitting machine, with the following yarns.

[Cylinder Side and Dial Side]

Non-elastic yarn: Ny, 33 dtex/26 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-1 and 4 below.

Example 15

Figure 16:
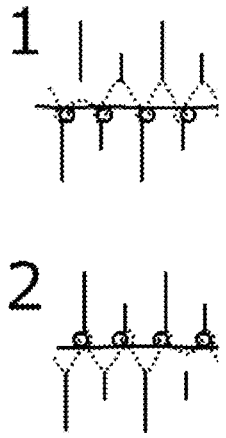
FIG. 16 shows an example of a knitting diagram for a knitted texture according to the embodiment.

A knitted fabric was knitted with the knitting diagram shown in FIG. 16 using a 32 gauge double circular knitting machine, with the following yarns.

[Cylinder Side and Dial Side]

Non-elastic yarn: Ny, 33 dtex/26 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-1 and 4 below.

Comparative Example 1

Figure 17:
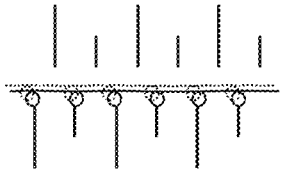
FIG. 17 shows an example of a knitting diagram for a knitted texture according to a comparative example.

A knitted fabric was knitted with the knitting diagram shown in FIG. 17 using a 28 gauge double circular knitting machine, with the following yarns.

[Cylinder Side]

Non-elastic yarn: Ny, 33 dtex/36 f, false-twisted

Elastic yarn: Pu, 22 dtex

The knitted fabric was relaxed and scoured with a continuous scouring machine, and then preset for 1 minute at 190° C. Dyeing was carried out with addition of the softener NICEPOLE PRN (product of Nicca Chemical Co., Ltd.) at 0.5% owf during dyeing, and then finish setting was carried out under conditions of 170° C., 1 minute and the obtained knitted fabric was used for sewing of a short sleeve inner wear piece, which was evaluated. The evaluation results are shown in Tables 3-2 and 4 below.

Comparative Example 2

Figure 18:
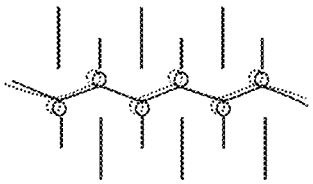
FIG. 18 shows an example of a knitting diagram for a knitted texture according to a comparative example.
Figure 18:
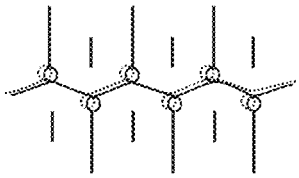

A knitted fabric was knitted with the knitting diagram shown in FIG. 18 using a 32 gauge double circular knitting machine, with the following yarns.

[Dial Side and Cylinder Side]

Non-elastic yarn: Cotton, 120/1

Elastic yarn: Pu, 33 dtex

The knitted fabric was relaxed and scoured with a continuous scouring machine, and then preset for 1 minute at 190° C. Dyeing was carried out with addition of the softener NICEPOLE PRN (product of Nicca Chemical Co., Ltd.) at 0.5% owf during dyeing, and then finish setting was carried out under conditions of 170° C., 1 minute and the obtained knitted fabric was used for sewing of a short sleeve inner wear piece, which was evaluated. The evaluation results are shown in Tables 3-2 and 4 below.

Comparative Example 3

A knitted fabric was knitted with the knitting diagram shown in FIG. 18 using a 32 gauge double circular knitting machine, with the following yarns.

[Dial Side and Cylinder Side]

Composite yarn: Composite yarn (Ny, 22 dtex/13 f+Cu, 33 dtex/26 f)

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-2 and 4 below.

Comparative Example 4

Figure 19:
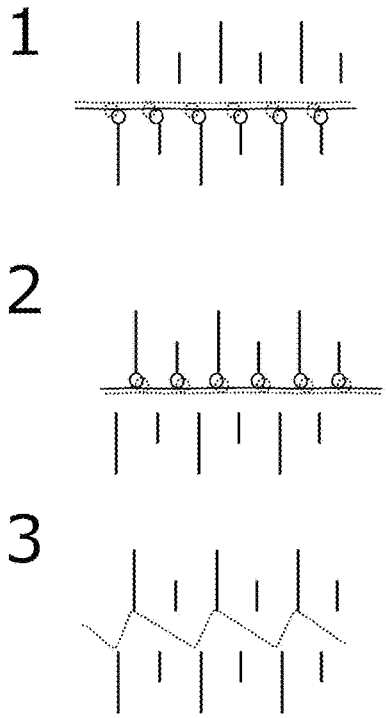
FIG. 19 shows an example of a knitting diagram for a knitted texture according to a comparative example.

A knitted fabric was knitted with the knitting diagram shown in FIG. 19 using a 28 gauge double circular knitting machine, with the following yarns.

[Cylinder Side]

Non-elastic yarn: Es, 56 dtex/34 f, raw yarn

Elastic yarn: Pu, 22 dtex

[Dial Side]

Non-elastic yarn: composite yarn (Ny, 22 dtex/13 f+Cu, 33 dtex/26 f)

Elastic yarn: Pu, 22 dtex

[Connect Yarn]

Elastic yarn: Pu, 33 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-2 and 4 below.

Comparative Example 5

A knitted fabric was knitted with the knitting diagram shown in FIG. 19 using a 28 gauge double circular knitting machine, with the following yarns.

[Cylinder Side and Dial Side]

Non-elastic yarn: Es, 56 dtex/34 f, raw yarn

Elastic yarn: Pu, 22 dtex

[Connect Yarn]

Elastic yarn: Pu, 75 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-2 and 4 below.

Comparative Example 6

A knitted fabric was knitted using a 28 gauge double circular knitting machine, replacing the elastic yarn with non-elastic yarn using the knitting diagram shown in FIG. 5 and with the following yarns.

[Cylinder Side and Dial Side]

Non-elastic yarn: Es, 56 dtex/34 f, raw yarn

Elastic yarn replacement Es, 33 dtex/24 f, raw yarn

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-2 and 4 below.

Comparative Example 7

A knitted fabric was knitted using a 28 gauge double circular knitting machine, replacing the elastic yarn with non-elastic yarn using the knitting diagram shown in FIG. 5 and with the following yarns.

[Cylinder Side and Cylinder Side]

Non-elastic yarn: Ny, 33 dtex/24 f, raw yarn

Elastic yarn replacement Ny, 33 dtex/24 f, heat-fused yarn

The knitted fabric was relaxed and scoured with a continuous scouring machine, and then preset for 1 minute at 180° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-2 and 4 below.

Comparative Example 8

Figure 20:
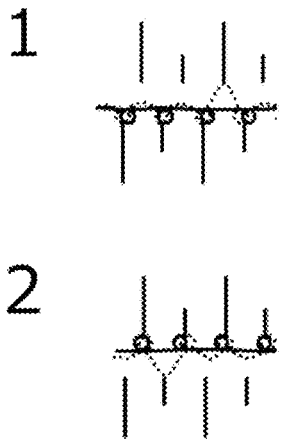
FIG. 20 shows an example of a knitting diagram for a knitted texture according to a comparative example.

A knitted fabric was knitted with the knitting diagram shown in FIG. 20 using a 32 gauge double circular knitting machine, with the following yarns.

[Cylinder Side and Dial Side]

Non-elastic yarn: Ny, 33 dtex/26 f, false-twisted

Elastic yarn: Pu, 22 dtex

The knitted fabric was relaxed and scoured with a continuous scouring machine, and then preset for 1 minute at 190° C. Dyeing was carried out with addition of the softener Nikka Silicon AMZ (product of Nicca Chemical Co., Ltd.) at 1.0% owf during dyeing, and then finish setting was carried out under conditions of 170° C., 1 minute and the obtained knitted fabric was used for sewing of a short sleeve inner wear piece, which was evaluated. The evaluation results are shown in Tables 3-2 and 4 below.

TABLE 1

| | Knitting conditions | | | | | | |
|---|---|---|---|---|---|---|---|
| | Yarn usage | Knitted structure | Knitting machine gauge | Percentage of number of needle loops formed by doubling of non-elastic yarn and elastic yarn with respect to total number of non-elastic yarn needle loops (%) | Percentage of number of sinker loops formed by doubling of non-elastic yarn and elastic yarn with respect to total number of non-elastic yarn sinker loops (%) | Percentage of number of courses with non-elastic yarn and elastic yarn knitted by plating, with respect to total number of courses (%) | Connection by non-elastic yarn |
| Ex. 1 | Cylinder side and dial side non-elastic yarn: Ny 33 dtex/26 f, false-twisted elastic yarn: Pu 22 dtex | FIG. 5 | 32 | 100 | 0 | 0 | Without |
| Ex. 2 | Cylinder side and dial side non-elastic yarn: Ny 44 dtex/34 f, raw elastic yarn: Pu 22 T | FIG. 5 | 28 | 100 | 0 | 0 | Without |
| Ex. 3 | Cylinder side and dial side non-elastic yarn: Ny 44 dtex/34 f, false-twisted elastic yarn: Pu 22 dtex | FIG. 5 | 36 | 100 | 0 | 0 | Without |
| Ex. 4 | Cylinder side non-elastic yarn: Es 56 dtex/34 f, raw elastic yarn: Pu 22 dtex, Dial side non-elastic yarn: composite yarn (Ny 22 dtex/13 f + Cu 33 dtex/26 f), elastic yarn: Pu 22 dtex | FIG. 5 | 28 | 100 | 0 | 0 | Without |
| Ex. 5 | Cylinder side and dial side non-elastic yarn: Ny 33 dtex/36 f, false-twisted elastic yarn: Pu 22 dtex | FIG. 6 | 28 | 100 | 0 | 0 | Without |
| Ex. 6 | Non-elastic yarn on cylinder side and dial side: Ny 33 dtex/26 f, false-twisted elastic yarn: Pu 22 dtex | FIG. 7 | 28 | 100 | 0 | 0 | Without |
| Ex. 7 | Cylinder side and dial side non-elastic yarn: Ny 33 dtex/26 f, false-twisted elastic yarn: Pu 22 dtex | FIG. 8 | 28 | 50 | 0 | 0 | With |
| Ex. 8 | Cylinder side and dial side non-elastic yarn: Ny 33 dtex/26 f, false-twisted elastic yarn: Pu 22 dtex | FIG. 9 | 28 | 50 | 0 | 0 | Without |
| Ex. 9 | Cylinder side and dial side non-elastic yarn: Ny 44 dtex/34 f, false-twisted elastic yarn: Pu 22 dtex | FIG. 10 | 28 | 50 | 0 | 0 | Without |

| | Knitting conditions | | | | | | |
|---|---|---|---|---|---|---|---|
| | Non-elastic yarn needle loop length (μm) | Non-elastic yarn sinker loop length (μm) | Non-elastic yarn needle loop/sinker loop length ratio | Non-elastic yarn only in knit structure | Alternate repeating of knit and tuck by elastic yarn | Elastic yarn included in all courses | Non-elastic yarn/elastic yarn loop length ratio in same course |
| Ex. 1 | 1251 | 684 | 0.54 | G | G | G | 1.4 |
| Ex. 2 | 1541 | 692 | 0.45 | G | G | G | 1.4 |
| Ex. 3 | 1159 | 578 | 0.50 | G | G | G | 1.4 |
| Ex. 4 | 1568 | 633 | 0.40 | G | G | G | 1.5 |
| Ex. 5 | 1931 | 1359 | 0.70 | P | G | G | 1.7 |
| Ex. 6 | 1910 | 1418 | 0.74 | P | P | G | 1.8 |

TABLE 1-continued

| | | | | | | | |
|---|---|---|---|---|---|---|---|
| Ex. 7 | 1522 | 702 | 0.46 | P | P | P | 1.3 |
| Ex. 8 | 1490 | 752 | 0.50 | G | G | P | 1.4 |
| Ex. 9 | 1466 | 817 | 0.56 | G | G | G | 2.1 |

TABLE 2

| | Properties | | | | Bending softness | Stretch property Stress at 40% | | | | | | | |
|---|---|---|---|---|---|---|---|---|---|---|---|---|---|
| | | | Stitch density | | Flexural rigidity | elongation | Free-cut property | | | | | Wearable feel | |
| | Basis weight | Thickness | Number of courses | Number of wales | (knitted fabric weft direction) | (knitted fabric weft direction) | Cut section curling | | Fray resistance (grade) | | | Comfort when | Skin contact |
| | ($g/m^2$) | (mm) | (c/inch) | (w/inch) | $CN \cdot cm^2/cm$ | CN | Weft | Warp | Weft | Warp | 45° | worn | at edges |
| Example 1 | 119 | 0.65 | 76 | 36 | 0.0034 | 71.9 | ≤5° | ≤5° | 5 | 5 | 5 | 4.9 | 4.9 |
| Example 2 | 139 | 0.57 | 70 | 40 | 0.0047 | 73.2 | ≤5° | ≤5° | 5 | 5 | 5 | 4.9 | 4.8 |
| Example 3 | 136 | 0.62 | 70 | 40 | 0.0050 | 80.6 | ≤5° | ≤5° | 5 | 5 | 5 | 4.8 | 4.7 |
| Example 4 | 156 | 0.80 | 76 | 44 | 0.0184 | 101.3 | ≤5° | ≤5° | 5 | 5 | 5 | 4.7 | 4.6 |
| Example 5 | 145 | 0.87 | 50 | 46 | 0.0142 | 105.5 | ≤5° | ≤5° | 3 | 4 | 5 | 4.5 | 4.1 |
| Example 6 | 155 | 0.90 | 55 | 52 | 0.0189 | 109.7 | ≤5° | ≤5° | 3 | 4 | 5 | 4.4 | 4.1 |
| Example 7 | 148 | 0.88 | 68 | 40 | 0.0195 | 124.7 | 15° | 15° | 3 | 3 | 4 | 4.2 | 4.1 |
| Example 8 | 105 | 0.52 | 65 | 40 | 0.0040 | 67.3 | 15° | 15° | 3 | 3 | 4 | 4.3 | 4.0 |
| Example 9 | 146 | 0.62 | 72 | 38 | 0.0072 | 90.4 | 15° | 15° | 3 | 4 | 4 | 4.3 | 4.1 |

TABLE 3-1

| | Knitting conditions | | | | | | |
|---|---|---|---|---|---|---|---|
| | Yarn usage | Knitted structure | Knitting machine gauge | Percentage of number of needle loops formed by doubling of non-elastic yarn and elastic yarn with respect to total number of non-elastic yarn needle loops (%) | Percentage of number of sinker loops formed by doubling of non-elastic yarn and elastic yarn with respect to total number of non-elastic yarn sinker loops (%) | Percentage of number of courses with non-elastic yarn and elastic yarn knitted by plating, with respect to total number of courses (%) | Connection by non-elastic yarn |
| Ex. 10 | Cylinder side and dial side non-elastic yarn: Ny 44 dtex/34 f, false-twisted elastic yarn: Pu 22 dtex | FIG. 11 | 28 | 75 | 0 | 0 | Without |
| Ex. 11 | Cylinder side and dial side non-elastic yarn: Ny 13 dtex/7 f, raw elastic yarn: Pu 22 dtex | FIG. 12 | 40 | 25 | 0 | 0 | Without |
| Ex. 12 | Cylinder side and dial side non-elastic yarn: Ny 13 dtex/7 f, raw elastic yarn: Pu 22 dtex | FIG. 13 | 40 | 33 | 0 | 0 | Without |
| Ex. 13 | Cylinder side and dial side non-elastic yarn: Ny 33 dtex/26 f, false-twisted elastic yarn: Pu 22 dtex | FIG. 14 | 32 | 100 | 50 | 0 | Without |
| Ex. 14 | Cylinder side and dial side non-elastic yarn: Ny 33 dtex/26 f, false-twisted elastic yarn: Pu 22 dtex | FIG. 15 | 32 | 100 | 50 | 50 | Without |
| Ex. 15 | Cylinder side and dial side non-elastic yarn: Ny 33 dtex/26 f, false-twisted elastic yarn: Pu 22 dtex | FIG. 16 | 32 | 100 | 25 | 0 | Without |

| | Knitting conditions | | | | | | |
|---|---|---|---|---|---|---|---|
| | Non-elastic yarn needle loop length (μm) | Non-elastic yarn sinker loop length (μm) | Non-elastic yarn needle loop/sinker loop length ratio | Non-elastic yarn only in knit structure | Alternate repeating of knit and tuck by elastic yarn | Elastic yarn included in all courses | Non-elastic yarn/elastic yarn loop length ratio in same course |
| Ex. 10 | 1452 | 771 | 0.53 | G | G | G | 1.8 |
| Ex. 11 | 1021 | 642 | 0.63 | G | G | x | 1.4 |
| Ex. 12 | 1051 | 655 | 0.62 | G | G | G | 1.4 |

TABLE 3-1-continued

| | | | | | | | |
|---|---|---|---|---|---|---|---|
| Ex. 13 | 1174 | 699 | 0.59 | G | x | G | 1.4 |
| Ex. 14 | 1237 | 546 | 0.44 | G | x | G | 3.0 |
| Ex. 15 | 1209 | 662 | 0.55 | G | x | G | 1.5 |

TABLE 3-2

| | Knitting conditions | | | | | | |
|---|---|---|---|---|---|---|---|
| | Yarn usage | Knitted structure | Knitting machine gauge | Percentage of number of needle loops formed by doubling of non-elastic yarn aid elastic yarn with respect to total number of non-elastic yarn needle loops (%) | Percentage of number of sinker loops formed by doubling of non-elastic yarn and elastic yarn with respect to total number of non-elastic yarn sinker loops (%) | Percentage of number of courses with non-elastic yarn and elastic yarn knitted by plating, with respect to total number of courses (%) | Connection by non-elastic yarn |
| Comp. Ex. 1 | Non-elastic yarn on cylinder side: Ny 33 dtex/36 f, false-twisted elastic yarn: Pu 22 dtex | FIG. 17 | 28 | 100 | 100 | 100 | Without |
| Comp. Ex. 2 | Cylinder side and dial side non-elastic yarn: cotton 120/1 elastic yarn: Pu 33 dtex | FIG. 18 | 32 | 100 | 100 | 100 | With |
| Comp. Ex. 3 | Cylinder side and dial side non-elastic yarn: composite yarn (Ny 22 dtex/13 f + Cu 33 dtex/26 f), elastic yarn: Pu 22 dtex | FIG. 18 | 32 | 100 | 100 | 100 | With |
| Comp. Ex. 4 | Cylinder side non-elastic yarn: Es 56 dtex/34 f, raw elastic yarn: Pu 22 dtex, Dial side non-elastic yarn: composite yarn (Ny 22 dtex/13 f + Cu 33 dtex/26 f), elastic yarn: Pu 22 dtex, Connect elastic yarn: Pu 33 dtex | FIG. 19 | 28 | 100 | 100 | 100 | Without |
| Comp. Ex. 5 | Cylinder side and dial side non-elastic yarn: Es 56 dtex/34 f, raw elastic yarn: Pu 22 dtex Connect elastic yarn: Pu 75 dtex | FIG. 19 | 28 | 100 | 100 | 100 | Without |
| Comp. Ex. 6 | Cylinder side and dial side non-elastic yarn: Es 56 dtex/34 f, raw elastic yarn replacement: Es 33 dtex/24 f raw yarn | FIG. 5* | 28 | — | — | — | With |
| Comp. Ex. 7 | Cylinder side and dial side non-elastic yarn: Ny 33 dtex/24 f, raw elastic yarn replacement: Ny 33 dtex/24 f heat-fused yarn | FIG. 5* | 28 | — | — | — | With |
| Comp. Ex. 8 | Non-elastic yarn on cylinder side and dial side: Ny 33 dtex/26 f, false-twisted elastic yarn: Pu 22 dtex | FIG. 20 | 32 | 100 | 75 | 0 | Without |

| | Knitting conditions | | | | | | |
|---|---|---|---|---|---|---|---|
| | Non-elastic yarn needle loop length (μm) | Non-elastic yarn sinker loop length (μm) | Non-elastic yarn needle loop/sinker loop length ratio | Non-elastic yarn only in knit structure | Alternate repeating of knit and tuck by elastic yarn | Elastic yarn included in all courses | Non-elastic yarn/elastic yarn loop length ratio in same course |
| Comp. Ex. 1 | 1712 | 336 | 0.20 | G | x | G | 3.1 |
| Comp. Ex. 2 | 1890 | 651 | 0.34 | x | x | G | 3.0 |
| Comp. Ex. 3 | 1723 | 627 | 0.36 | x | x | G | 3.0 |
| Comp. Ex. 4 | 1803 | 345 | 0.19 | G | x | G | 3.2 |
| Comp. Ex. 5 | 1925 | 431 | 0.23 | G | x | G | 3.0 |
| Comp. Ex. 6 | 1744 | 729 | 0.42 | x | x | x | — |
| Comp. Ex. 7 | 1801 | 727 | 0.40 | x | x | x | — |
| Comp. Ex. 8 | 1182 | 539 | 0.46 | G | x | G | 2.1 |

*Knitted structure with elastic yarn of FIG. 5 replaced with non-elastic yarn

TABLE 4

| | Properties | | | | Bending softness | Stretch property Stress at 40% | | | | | | | |
|---|---|---|---|---|---|---|---|---|---|---|---|---|---|
| | | | Stitch density | | Flexural rigidity | elongation | Free-cut property | | | | | Wearable feel | |
| | Basis weight | Thickness | Number of courses | Number of wales | (knitted fabric weft direction) | (knitted fabric weft direction) | Cut section curling | | Fray resistance (grade) | | | Comfort when | Skin contact |
| | ($g/m^2$) | (mm) | (c/inch) | (w/inch) | CN · $cm^2$/cm | CN | Weft | Warp | Weft | Warp | 45° | worn | at edges |
| Example 10 | 152 | 0.65 | 70 | 37 | 0.0090 | 103.3 | ≤5° | ≤5° | 3 | 4 | 5 | 4.3 | 4.4 |
| Example 11 | 89 | 0.43 | 92 | 62 | 0.0043 | 68.3 | 45° | 45° | 3 | 3 | 3 | 3.7 | 2.8 |
| Example 12 | 91 | 0.45 | 94 | 60 | 0.0082 | 168.0 | 40° | 40° | 3 | 3 | 3 | 3.8 | 2.9 |
| Example 13 | 127 | 0.69 | 76 | 46 | 0.0198 | 121.5 | ≤5° | ≤5° | 5 | 5 | 5 | 3.7 | 4.2 |
| Example 14 | 129 | 0.72 | 76 | 47 | 0.0221 | 172.0 | ≤5° | ≤5° | 5 | 5 | 5 | 3.5 | 4.0 |
| Example 15 | 125 | 0.70 | 76 | 45 | 0.0142 | 97.0 | ≤5° | ≤5° | 5 | 5 | 5 | 4.0 | 4.2 |
| Comp. Example 1 | 122 | 0.54 | 100 | 52 | 0.0228 | 132.1 | 60° | 60° | 4 | 5 | 5 | 4.1 | 2.1 |
| Comp. Example 2 | 209 | 0.98 | 110 | 54 | 0.0324 | 135.2 | ≤5° | ≤5° | 3 | 3 | 3 | 3.4 | 3.1 |
| Comp. Example 3 | 198 | 0.76 | 90 | 44 | 0.0233 | 121.0 | ≤5° | ≤5° | 3 | 4 | 3 | 3.8 | 3.7 |
| Comp. Example 4 | 233 | 0.8 | 70 | 58 | 0.0407 | 225.1 | 60° | ≤5° | 5 | 5 | 5 | 2.7 | 2.9 |
| Comp. Example 5 | 304 | 1.27 | 70 | 50 | 0.1260 | 294.0 | ≤5° | ≤5° | 3 | 4 | 2 | 2.3 | 2.4 |
| Comp. Example 6 | 167 | 1.05 | 70 | 42 | 0.0348 | 144.0 | ≤5° | ≤5° | 1 | 1 | 2 | 2.5 | 1.8 |
| Comp. Example 7 | 181 | 1.14 | 72 | 42 | 0.2805 | 417.0 | ≤5° | ≤5° | 5 | 5 | 5 | 1.7 | 2.9 |
| Comp. Example 8 | 132 | 0.68 | 76 | 52 | 0.0301 | 157.4 | ≤5° | ≤5° | 5 | 5 | 5 | 3.3 | 3.7 |

INDUSTRIAL APPLICABILITY

Since the weft knit fabric of the invention has an excellent free-cut property and wearable feel and does not impair the aesthetic appearance even when used as free-cut clothing, it can be suitably used for underwear or sports wear.

REFERENCE SIGNS LIST

1 Horizontal knitted fabric set on machine
2 Straight line contacting horizontal knitted fabric
3 Straight line contacting curled knitted fabric edge
d Curl angle

The invention claimed is:

1. A weft knit fabric comprising non-elastic yarn and elastic yarn and having a front side and a back side, wherein the elastic yarn connects the front side and back side, with the front side and the back side having sections that form needle loops by doubling of the non-elastic yarn and the elastic yarn, and the proportion of the number of sinker loops formed by doubling of the non-elastic yarn and elastic yarn is 50% or lower with respect to the total number of sinker loops of the non-elastic yarn on the front side and the back side, and when the weft knit fabric is elongated with a load of 9.8 N from both a warp and a weft, the ratio between the needle loop lengths and the sinker loop lengths of the non-elastic yarn loops is 0.20 to 0.80.

2. The weft knit fabric according to claim 1, which has no sections where the non-elastic yarn and elastic yarn form sinker loops by doubling.

3. The weft knit fabric according to claim 1, wherein the proportion of the number of needle loops formed by doubling between the non-elastic yarn and the elastic yarn is 50% or greater with respect to the total number of needle loops of non-elastic yarn on the front side and the back side.

4. The weft knit fabric according to claim 1, wherein the non-elastic yarn composing either the front side or the back side does not connect with the other side.

5. The weft knit fabric according to claim 1, wherein the non-elastic yarn forms only a knit structure on the front side and the back side.

6. The weft knit fabric according to claim 1, which has a structure in which the elastic yarn alternately repeats a knit structure on either the front side or the back side and a tuck structure on the other side, in the weft direction of the knitted fabric.

7. The weft knit fabric according to claim 1, wherein the elastic yarn is coalesced or fused together.

8. The weft knit fabric according to claim 1, wherein the elastic yarn and the non-elastic yarn are coalesced or fused together.

9. The weft knit fabric according to claim 1, wherein elastic yarn is included in all of the courses of the weft knit fabric.

10. The weft knit fabric according to claim 1, wherein the proportion of the number of courses where the non-elastic yarn and elastic yarn are knitted by plating is 50% or lower with respect to the total number of courses.

* * * * *